US008727740B2

(12) United States Patent
Jiang et al.

(10) Patent No.: US 8,727,740 B2
(45) Date of Patent: May 20, 2014

(54) CYLINDER ASSEMBLY FOR PROVIDING UNIFORM FLOW OUTPUT

(75) Inventors: Fangfang Jiang, Stafford, TX (US); Philippe Gambier, Houston, TX (US); Rod Shampine, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 1638 days.

(21) Appl. No.: 11/962,637

(22) Filed: Dec. 21, 2007

(65) Prior Publication Data

US 2008/0170954 A1 Jul. 17, 2008

Related U.S. Application Data

(60) Provisional application No. 60/883,682, filed on Jan. 5, 2007.

(51) Int. Cl.
*F04B 17/00* (2006.01)
*F04B 35/00* (2006.01)

(52) U.S. Cl.
USPC ..... 417/225; 91/183

(58) Field of Classification Search
USPC ..... 417/529, 540, 20, 22, 383, 339, 343, 417/415; 91/183, 515, 517; 74/89.2, 89.22, 74/110
See application file for complete search history.

(56) References Cited

U.S. PATENT DOCUMENTS 2,579,568 A * 12/1951 Habenicht ..... 417/85
2,858,767 A * 11/1958 Smith ..... 417/346
3,620,134 A * 11/1971 Conlon et al. ..... 92/39
3,816,029 A * 6/1974 Bowen et al. ..... 417/223
4,214,704 A 7/1980 Nagai
4,245,963 A * 1/1981 Hutchins et al. ..... 417/265
4,359,312 A * 11/1982 Funke et al. ..... 417/18
4,543,044 A * 9/1985 Simmons ..... 417/342
4,915,591 A * 4/1990 Funke ..... 417/18
4,969,756 A 11/1990 Villec et al.
5,015,004 A 5/1991 Mitchell
5,152,675 A * 10/1992 Morris ..... 417/343
5,165,869 A * 11/1992 Reynolds ..... 417/385
5,273,349 A 12/1993 Kidston
5,281,009 A 1/1994 Kidston et al.
5,308,153 A 5/1994 Kidston et al.
5,316,453 A * 5/1994 Schwing ..... 417/516
5,325,761 A * 7/1994 Schwing ..... 91/31
5,337,561 A * 8/1994 Raghavan et al. ..... 60/421
5,363,650 A 11/1994 Bodycoat et al.
5,377,755 A * 1/1995 Michaels et al. ..... 166/264
5,379,737 A 1/1995 Hu
6,206,658 B1 * 3/2001 Nishioka et al. ..... 417/400
6,293,756 B1 * 9/2001 Andersson ..... 417/3
6,488,487 B2 * 12/2002 Minato ..... 417/540
6,609,898 B1 * 8/2003 Bury ..... 417/347
6,652,741 B1 * 11/2003 Marinzet ..... 210/101
7,779,629 B2 * 8/2010 Isono et al. ..... 60/413
7,905,713 B2 * 3/2011 Hofmann et al. ..... 417/521

* cited by examiner

*Primary Examiner* — Charles Freay
*Assistant Examiner* — Amene Bayou
(74) *Attorney, Agent, or Firm* — Rachel Greene; Tim Curington

(57) ABSTRACT

An assembly in accordance with an embodiment of the present invention for providing a substantially uniform output flow from at least one piston of a pump powered by a prime mover includes at least a first power piston disposed in a cylinder and reciprocatingly movable within the cylinder between an extension direction when supplied with power from the prime mover and an opposite retraction direction, and a synchronization element attached to the power piston to control the speed of the power piston in the retraction direction.

17 Claims, 5 Drawing Sheets

1 OPEN, 2 CLOSED, 4 OPEN, 5 CLOSED, 3 CLOSED - A
1 CLOSED, 2 OPEN, 4 CLOSED, 5 OPEN, 3 CLOSED - B
1 OPEN, 2 OPEN, 4 CLOSED, 5 CLOSED, 3 CLOSED - C
1 OPEN, 2 CLOSED, 4 CLOSED, 5 CLOSED, 3 OPEN - (A+B) D

1 OPEN, 2 CLOSED, 4 OPEN, 5 CLOSED, 3 CLOSED - A
1 CLOSED, 2 OPEN, 4 CLOSED, 5 OPEN, 3 CLOSED - B
1 OPEN, 2 OPEN, 4 CLOSED, 5 CLOSED, 3 CLOSED - C
1 OPEN, 2 CLOSED, 4 CLOSED, 5 CLOSED, 3 OPEN - (A+B) D

CYLINDER ASSEMBLY FOR PROVIDING UNIFORM FLOW OUTPUT

CROSS REFERENCE TO RELATED APPLICATIONS

This application is entitled to the benefit of U.S. provisional patent application 60/883,682, filed Jan. 5, 2007, the entire disclosure of which is incorporated herein by reference.

BACKGROUND OF THE INVENTION

The present invention relates generally to hydraulic cylinder assemblies, and more particularly to a system, apparatus and/or method for controlling the pistons of the hydraulic cylinder assembly.

Hydraulic cylinder assemblies with internal pistons and/or rods are widely used as force transforming devices in different fields, including pressure multipliers utilized in wellbore servicing operations such as fracturing or the like. Such assemblies may comprise a power piston disposed in a cylinder and reciprocatingly movable within the cylinder between an extension direction and an opposite retraction direction. The piston may be further connected to auxiliary pistons or the like for pumping a working fluid to a working fluid output. The speed of the power piston in the extension and retraction directions is disadvantageously uncontrolled and there may be a significant difference in the speed of the piston in the extension and retraction directions, disadvantageously resulting in uneven or highly varied output flow to the working fluid output.

Accordingly, a need exists for a system, apparatus, and/or method for providing a substantially uniform flow to a working fluid output, such as by controlling the above described piston movements or the like.

SUMMARY OF THE INVENTION

An assembly in accordance with an embodiment of the present invention for providing a substantially uniform output flow from at least one piston of a pump powered by a prime mover includes at least a first power piston disposed in a cylinder and reciprocatingly movable within the cylinder between an extension direction when supplied with power from the prime mover and an opposite retraction direction, and a synchronization element attached to the power piston to control the speed of the power piston in the retraction direction.

Alternatively, the synchronization element comprises a spring member. The spring member may bias the piston in the retraction direction. Alternatively, the at least one piston is connected to an output rod extending from the cylinder. Alternatively, the synchronization element increases the speed of the piston in the retraction direction. Alternatively, the prime mover powers a hydraulic source for supplying hydraulic pressure to a power side of the power piston.

In an alternative embodiment, an assembly for providing a substantially uniform output flow in a pressure multiplier pump includes a prime mover operable to supply power, a plurality of power pistons each disposed in a cylinder and reciprocatingly movable within the cylinder between an extension direction when supplied with power from the prime mover and an opposite retraction direction, and a synchronization element attached to each of the power pistons to control the speed of the power pistons in the retraction direction.

Alternatively, the pump is a one of a duplex, a triplex pump, a four-plex pump, and a quintuplex pump. Alternatively, the prime mover powers a hydraulic source for supplying hydraulic pressure to a power side of each of the power pistons. Alternatively, the synchronization element increases the speed in the retraction direction of each of the pistons while at least one of the other pistons is moving in the extension direction. Alternatively, each of the pistons are connected to an output rod extending from the cylinder. Each of the output rods may be further connected to a pressure multiplier piston.

Alternatively, the synchronization element retracts the power pistons at different speeds. Alternatively, the synchronization element comprises an auxiliary piston connected to each power piston and further comprising a replenishing pump supplying pressured hydraulic fluid to the auxiliary pistons to control the speed of the power pistons. The synchronization element may comprise a compensating cylinder assembly attached to each of the power pistons. A predetermined flow of oil to the compensating cylinder assembly may increase the speed in the retraction direction of a power piston while another power piston is moving in the extension direction. Alternatively, the synchronization element comprises a cable attached to each of the power pistons, the cables routed along a plurality of pulleys, at least one the pulleys movably attached to a compensation cylinder.

In an alternative embodiment, an assembly for providing a substantially uniform flow output from a multi-piston pressure multiplier includes a prime mover operable to provide a supply of pressured hydraulic fluid, and a plurality of power pistons each disposed in a cylinder and including a power side and an opposite return side, each of the power pistons reciprocatingly movable within the cylinder between an extension direction when the power side of the piston is supplied with pressured hydraulic fluid from the prime mover and an opposite retraction direction. An output rod is connected to each of the power pistons, each of the output rods extends from the cylinder and is further connected to a pressure multiplier piston. Each of the pressure multiplier pistons in in fluid communication with a source of pumping fluid and a discharge destination for the pumping fluid. The assembly also includes an element attached to a one of the power pistons and an output of the pressure multiplier pistons to provide substantially uniform flow output from the pressure multiplier pistons to the discharge destination for the pumping fluid.

Alternatively, the element is a synchronization element attached to each of the power pistons to control the speed of the power piston in the retraction direction by increasing the speed of the power piston in the retraction direction.

Alternatively, the element is a pressure conditioning system attached to an output of the pressure multiplier pistons, the pressure conditioning system comprising a piston in fluid communication with an output of the prime mover and the output of the pressure multiplier pistons and operable to store pumping fluid and release pumping fluid to the discharge destination when flow from the output of the pressure multiplier pistons drops below a predetermined value.

Alternatively, the assembly further comprises an intermediate rod disposed between the power pistons and a plurality of valves operable to communicate flow from the pressured hydraulic fluid to the power sides and return sides of each of the power pistons and from the power sides and return sides of each of the power pistons to the sump in predetermined combinations, each of the combinations operable to produce a predetermined pressure and flow to the discharge destination.

In an alternative embodiment, a method for providing a fluid to a wellbore formed in a subterranean formation includes providing a pump assembly that includes a prime mover operable to provide a supply of pressured hydraulic fluid, the prime mover including a plurality of power pistons each disposed in a cylinder and including a power side and an opposite return side, each of the power pistons reciprocatingly movable within the cylinder between an extension direction when the power side of the piston is supplied with pressured hydraulic fluid from the prime mover and an opposite retraction direction. An output rod is connected to each of the power pistons, each of the output rods extending from the cylinder and further connected to a pressure multiplier piston, each of the pressure multiplier pistons having an input in fluid communication with a source of pumping fluid and an output. The method further comprises connecting the output of the pressure multiplier pistons to a wellbore formed in a subterranean formation and operating the prime mover to pump fluid from the source of pumping fluid to the wellbore and providing a substantially uniform flow of pumping fluid to the wellbore utilizing an element attached to a one of the power pistons and an output of the pressure multiplier pistons.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION OF THE INVENTION

Figure 1:
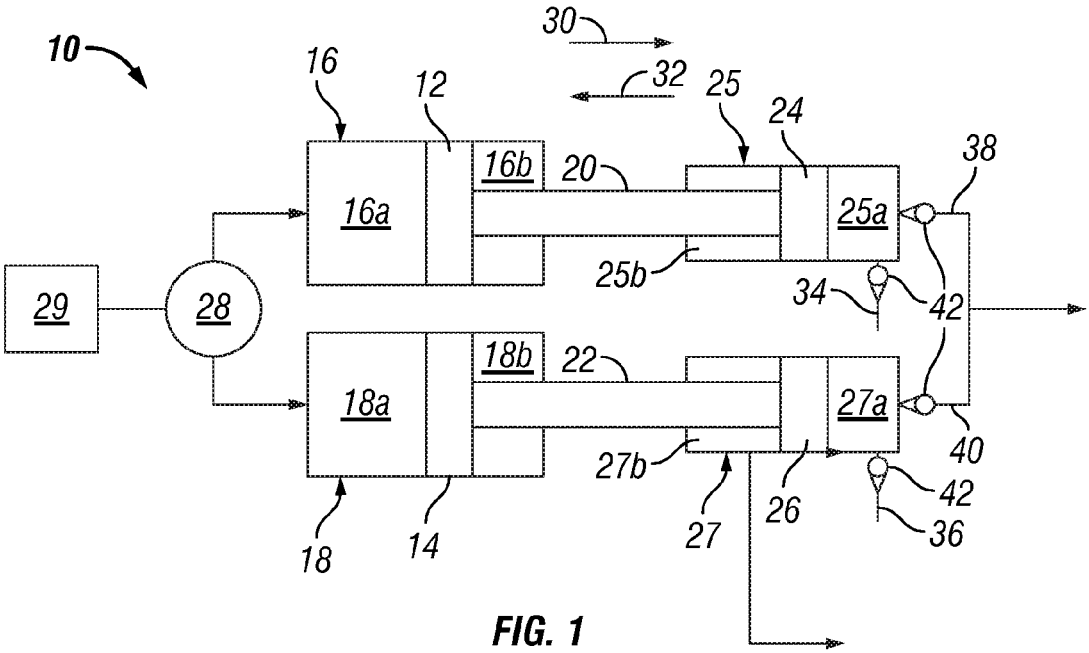
FIG. 1 (Prior Art)
FIG. 1 is a schematic view of a hydraulic cylinder assembly of the prior art.

Referring now to FIG. 1, there is shown a hydraulic cylinder assembly 10 of the prior art that comprises a first piston 12 and a second piston 14 each disposed in a respective cylinder 16 and 18. An output rod 20 and 22 extends from each piston 16 and 18 out of the cylinders 16 and 18 and is operatively connected to a respective auxiliary piston 24 and 26, such as a multiplier piston or the like, which are disposed in respective cylinders 25 and 27. The cylinder 16 has a power side 16*a* and a return side 16*b* and the cylinder 18 has a power side 18*a* and a return side 18*b*. The cylinder 25 has a power side 25*a* and a return side 25*b* and the cylinder 27 has a power side 27*a* and a return side 27*b*. The power sides 16*a* and 18*a* of the cylinders 16 and 18 are each supplied with power from a source of pressured fluid 28 and are operable to reciprocatingly move the pistons 12 and 14, along with output rods 20 and 22 and auxiliary pistons 24 and 26, in an extension direction as indicated by an arrow 30 and an opposite retraction direction as indicated by an arrow 32. Those skilled in the art will appreciate that the source of pressured fluid 28 may be a liquid or gas including, but not limited to, an output from a prime mover 29, such as, but not limited to, a variable displacement hydraulic pump and motor unit or similar type of prime mover and pump apparatus or assembly while remaining within the scope of the present invention. The prime mover 29 may be a diesel engine, an electric motor or the like.

The power sides 25*a* and 27*a* of the cylinders 25 and 27 each include a respective input line 34 and 36 connected to a working fluid supply (not shown) and output line 38 and 40 connected to a working fluid output (not shown). The input lines 34 and 36 and output lines 38 and 40 are connected to the cylinders 25 and 27 of the auxiliary pistons 24 and 26 by suitable check valves 42. Those skilled in the art will appreciate that the working fluid may be any type of fluid or gas including, but not limited to, fracturing fluid for a wellbore operation or the like. During a first half of a cycle in the operation of the assembly 10, the piston 12 moves in the extension direction 30 while the piston 14 moves in the retraction direction 32. During a second half of the cycle of operation of the assembly 10, the piston 12 moves in the retraction direction 32 while the piston 14 moves in the extension direction 30. The ends 16*b* and 18*b* preferably include no pressurized fluid disposed therein. Alternatively, the ends 16*b* and 18*b* include a pressurized fluid such as oil, air, or the like to assist in moving the pistons 12 and 14 in the retraction direction 32.

For example, in the assembly 10 shown in FIG. 1, it may be desirable that the speed of the retracting piston 12 or 14 be faster than that of the extending piston 12 or 14 in order to compensate the flow variation during the transition period, such as when the pistons 12 or 14 accelerates and decelerates when changing directions between the extension direction 30 and the retraction direction 32. It is desirable to provide a substantially constant or continuous fluid flow to the working fluid output downstream of pistons 25 and 27.

Figure 2:
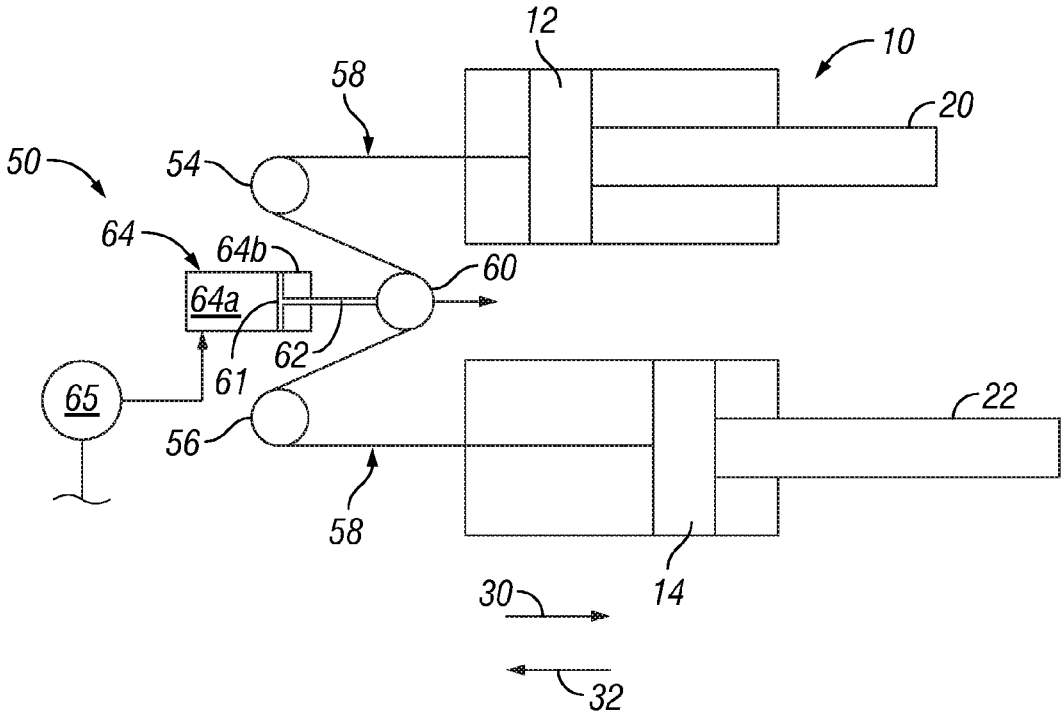
FIG. 2 is a schematic view of an embodiment of a system for providing a uniform flow output in accordance with the present invention.

An embodiment of a system of the present invention is indicated generally at 50 in FIG. 2. The system 50 is shown attached to the assembly 10 of FIG. 1 (shown in partial view not including the auxiliary pistons 24 and 26 and with other reference numerals not shown for clarity) and includes a synchronization element, indicated generally at 52. The synchronization element 52 comprises a first fixed pulley 54 and a second fixed pulley 56, each of which is attached to a respective power piston 12 and 14 by a flexible cable 58 or similar type device. A third movable pulley 60 is also connected to the cable 58 and is movably attached to a piston rod 62 of a piston 61 disposed in a compensation cylinder 64 having a power side 64*a* and a return side 64*b*.

Where a continuous flow from the auxiliary pistons 24 and 26 (not shown in FIG. 2) to the working fluid output is desired, a faster speed in the retraction direction 32 for the pistons 12 and 14 than the speed in the extension direction 30 of the pistons 12 and 14 must be provided, which is achieved by the operation of the system 50 shown in FIG. 2. When high pressure fluid, such as, for example, about 5000 psi hydraulic fluid, from the power or pressured fluid source 28 is supplied to the power side 16*a* of cylinder 16, the piston 12 extends with a constant speed ve1 in the extension direction 30. At substantially the same time, an oil pressure on the power side 18*a* and return side 18*b* of the cylinder 18 is at a low pressure, such as the pressure in a fluid reservoir (not shown). The piston 12 will pull the cable 58 and hence piston 14 will move in the retraction direction 32. If the piston rod 62 of the compensation cylinder 64 applies a force to the pulley 60, so that the pulley 60 moves from an original position at a speed of $\Delta v$, in the extension direction 30, thereby exerting additional tension and, therefore, additional speed on the cable 58, the piston 14 will move in the retraction direction 32 at a speed of $(ve1+\Delta v)$. The force to the compensation cylinder 64 and therefore the pulley 60 is preferably applied by a relatively low pressure fluid from a fluid source 65, such as hydraulic oil or air (for example at about 100 psi) supplied at to the power side 64*a* of the compensation cylinder 64. The speed of the pistons 12 and 14 in the extension direction 30 is preferably controlled by a controller (not shown) or the like directing the flow of high pressure fluid to the respective power sides 16*a* and 18*a* of the cylinders 16 and 18.

The speed Δv of the compensation cylinder piston 61 is preferably controlled by the flow rate of this low pressure oil supply to the power side 64*a* of the cylinder 64. By varying the rate of fluid flow to the compensation cylinder 64, the speed in the retraction direction 32 of either the piston 14 or the piston 12 may be controlled. The piston 14 moves in the retraction direction 32 faster than the piston 12 moves in the extension direction 30. When the piston 14 reaches an end of its travel (such as a predetermined top dead center position or the like), high pressure oil (for example about 5000 psi) from the power source 28 is supplied to the power side 18*a* of the cylinder 18. This force, in addition to the high pressure force at the power side 16*a* of the cylinder 16, will work against the force applied by the compensation cylinder 64 (which is much smaller than the force applied on pistons 12 and 14) thereby pulling the pulley 60 and the piston 61 in the retraction direction 32 toward its original position. When the pulley 60 reaches its original position, a new cycle will begin with piston 14 moving in the extension direction 30 and the piston 12 moving in the retraction direction 32. The flow of fluid from the source 28 to the pistons 12 and 14 and source 65 of low pressure oil to the compensation cylinder piston 64 is preferably directed by a suitable valving and a controller or the like, receiving control signals (not shown), such as pressure, temperature, and position indication, from each of the components of the assembly 10 and system 50.

Figure 3:
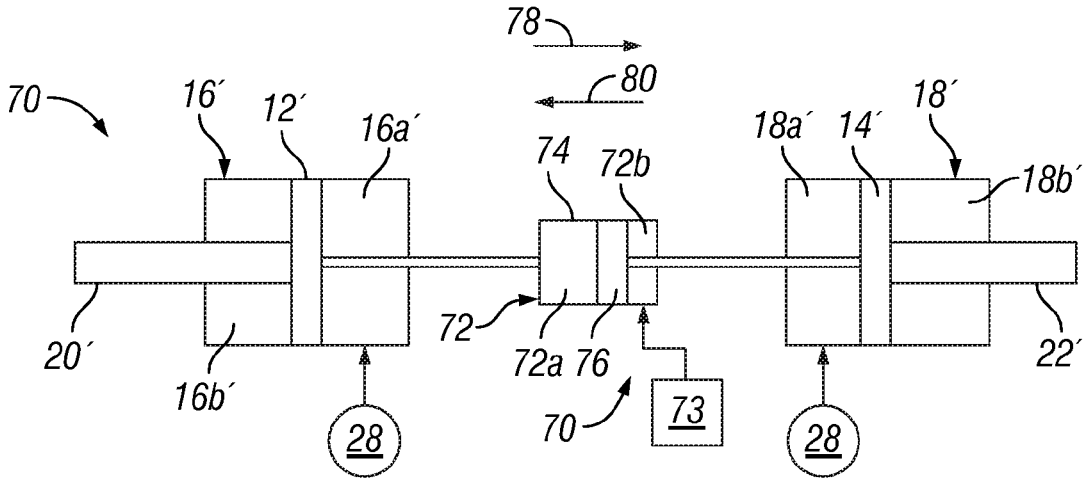
FIG. 3 is a schematic view of an alternative embodiment of a system in accordance with the present invention.

Referring now to FIG. 3, an alternative embodiment of a system in accordance with the present invention is indicated generally at 70. The system or compensating cylinder assembly 70 includes a synchronization element or compensation cylinder 72 that is interposed directly between sides 16*a*' and 18*a*' of a piston 12' and a piston 14', corresponding to pistons 12 and 14 and cylinders 16 and 18 shown in FIGS. 1 and 2. The compensation cylinder 72 includes a first side 72*a* and a second side 72*b* defined by a movable cylinder shell 74. A piston 76 is slidably disposed within the cylinder shell 74. The compensation cylinder shell 74 and the piston 76 can each move in a reciprocating manner in the directions indicated by opposing arrows 78 and 80. During movement in the direction 78, the piston 12' is retracting and the piston 14' is extending. During movement in the direction 80, the piston 14' is retracting and the piston 12' is extending.

The velocity difference between the speed in the retraction direction 32 of one piston 12' and 14' and the speed in the extension direction 30 of the piston 12' and 14' is compensated by the compensation cylinder 72. For example, when the pistons 12' and 14' move in the direction 78, the piston 12' is moving in the retraction direction 32 and the piston 14' is moving in the extension direction 30. The high pressure fluid from the source 28 is supplied to the power side 18*a*' of the cylinder 18'. If no pressure is applied to either the power side 16*a*' or return side 16*b*' of the cylinder 16' and the compensation piston 72, this force will move the piston 14', the compensation cylinder and the piston 12' in the direction 78 with the same speed as a rigid part (disregarding a slight volume change because of the compression on the second side 72*b* of the compensation cylinder 72). If relatively low pressure fluid such as, for example, fluid at about 100 psi from a fluid source 73, is applied to the second side 72*b* of the compensation cylinder 72, this force will cause a relative movement between the piston 76 and the shell 74. Since the compensation piston 76 has the same speed as the piston 14', the compensation cylinder shell 74 will move in the direction 78 relative to the pistons 12' and 14', increasing the speed of the piston 12' in the direction 78 of the piston 12'. The relative speed of the retracting piston 12' or 14', therefore, can be controlled by how fast the fluid is supplied to the second side 72*b* of the compensation cylinder 72. The end 72*a* preferably includes no pressurized fluid disposed therein. Alternatively, the end 72*a* includes a pressurized fluid such as oil, air, or the like to assist in moving the pistons 12' and 14' in their respective retraction directions.

The compensation cylinders 64 and 72 shown in FIGS. 2 and 3 are acting as a spring or damper with a controlled speed in the retraction direction 32 between the two cylinders 16, 16', 18, and 18' to compensate the velocity difference between the two pistons 12, 12', 14 and 14'. Such an arrangement can be applied to situations other than the assembly 10 shown in FIG. 1. As described above, the movement in the retraction direction 78 of the piston 14' is driven by the movement in the extension direction 80 of the piston 12' and the compensation cylinder 64 or 72 ($v_{e1}+\Delta v$). By controlling Δv (by varying the flow of fluid to the compensation cylinder 64 or 72), the system 50 or 70 can be applied to various applications where different speeds in the extension direction and retraction directions 78 or 80 are desirable.

Figure 4:
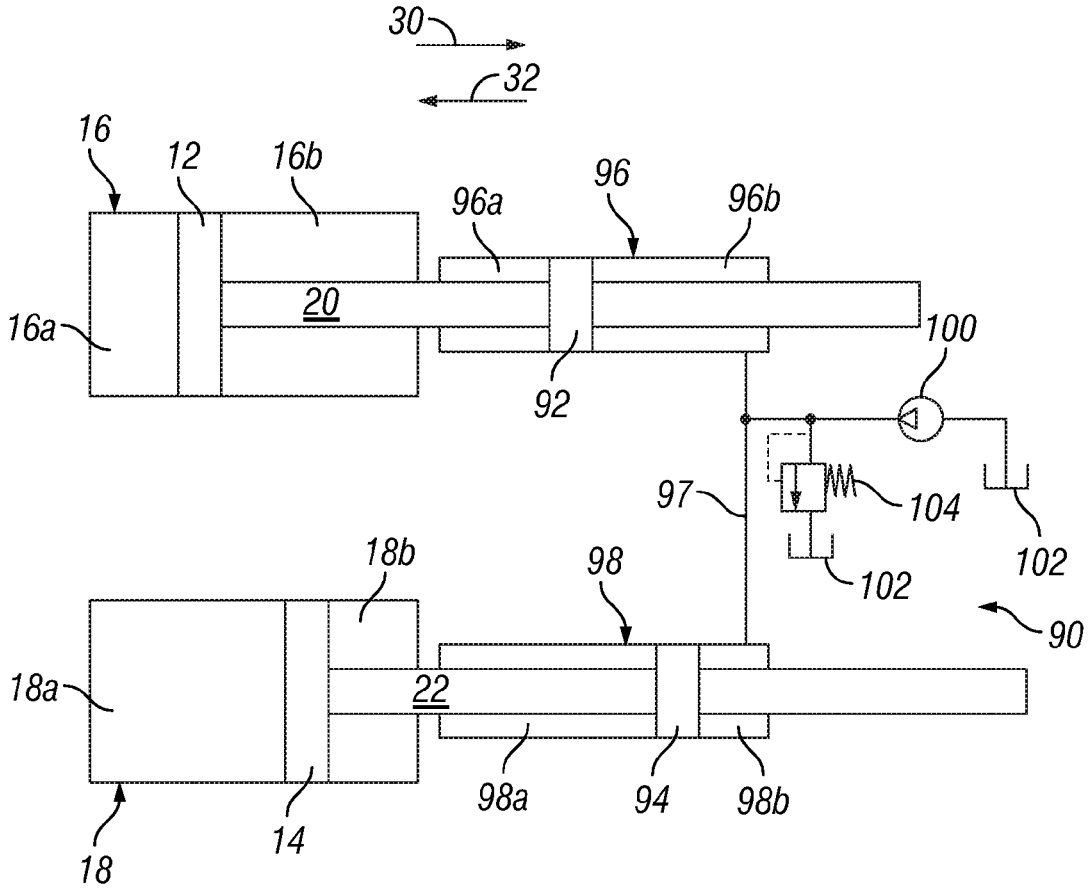
FIG. 4 is a schematic view of an alternative embodiment of a system in accordance with the present invention.

Referring now to FIG. 4, an alternative embodiment of a system in accordance with the present invention is indicated generally at 90. Each of the output rods 20 and 22 extending from the pistons 12 and 14 are further connected to auxiliary compensation pistons 92 and 94, respectively. The compensation pistons 92 and 94 of are each disposed in a respective auxiliary compensation cylinder 96 and 98 having first sides 96*a* and 98*a*, and a second side 96*b* and 98*b*, respectively. The second sides 96*b* and 98*b* are in fluid communication with each other through a line or conduit 97 and a replenishing pump 100. The replenishing pump 100 is in fluid communication with a fluid source 102 and is operable to supply pressured fluid to the second sides 96*b* and 98*b* of the auxiliary compensation cylinders 96 and 98. A relief valve 104 is operable to relieve high pressure on the output of the pump 100 to the fluid source.

When the piston 14 moves in the extension direction 30, fluid displaced from the second side 98*b* of the auxiliary piston 94 will be routed into the second side 96*b* of the cylinder 96. If the replenishing pump 100 was not installed and the oil leakage is ignored, the auxiliary piston 92 and the piston 12 would move in the retraction direction 32 at the same speed as the piston 14 and auxiliary compensation piston 94 move in the extension direction. With the replenishing pump 100 as shown in the circuit, pressured fluid is provided to the second side 96*b* of the cylinder 96. The flow rate of the fluid to the second side 96*b* of the cylinder 96 determines the velocity difference between the pistons 12 and 14. When the auxiliary compensation piston 92 reaches an end of its travel (such as a predetermined top dead center position or the like), the pistons 12 and 92 will begin to move in the extension direction 30 while the pistons 14 are 94 are still moving in the extension direction 30. Extra fluid displaced between the pistons 92 and 94 is released through the relief valve 104 to the source 102. The setpoint of the relief valve 104 is preferably high enough to provide the force required to retract the pistons 92 and 94 when no load is applied. The ends 16*b*, 18*b*, 96*a*, and 96*b* preferably include no pressurized fluid disposed therein. Alternatively, the ends 16*b*, 18*b*, 96*a*, and 96*b* include a pressurized fluid such as oil, air, or the like to assist in moving the pistons 12 and 14 in the retraction direction 32.

Alternatively, the replenishing pump 100 and the relief valve 104 are replaced by an accumulator, as will be appreciated by those skilled in the art. The initial pressure in the accumulator is preferably high enough to provide the force to retract the pistons (the same as the relief pressure of the relief valve 104 in the system 90).

Figure 5:
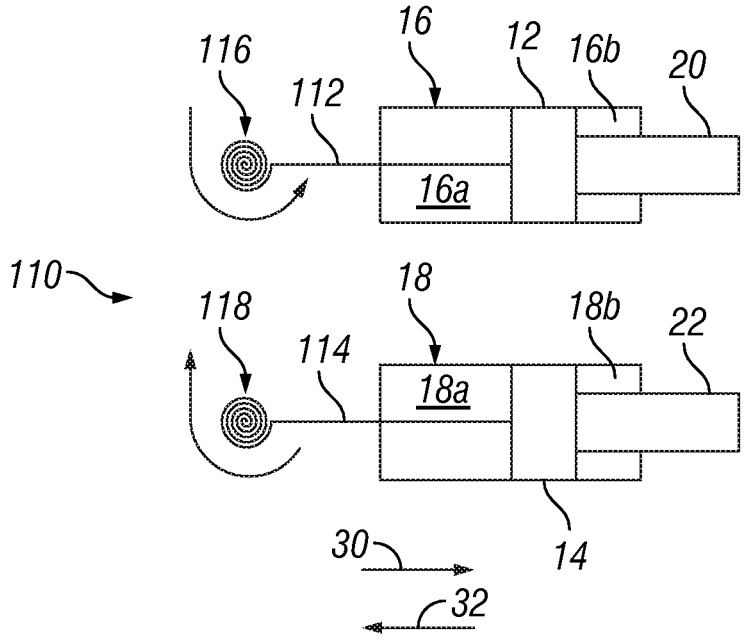
FIG. 5 is a schematic view of an alternative embodiment of a system in accordance with the present invention.

Referring now to FIG. 5, an alternative embodiment of a system in accordance with the present invention is indicated generally at 110. A spool of cable 112 is attached to the piston 12 and a spool of cable 114 is attached to the piston 14. Each of the spools 112 and 114 is loaded by a respective spring 116 and 118. When the piston 12 or 14 moves in the extension direction 30, the energy is stored in the spring 116 or 118. When the high pressure fluid is removed from and/or no longer supplied to the power side 16*a* or 16*b* of the cylinder 16 or 18, the piston 12 or 14 will be retracted by the energy released from the spring 116 or 118. By choosing different spring constants for the springs 116 and 118, the piston 12 or 14 can be retracted with different speeds.

Alternatively, the retraction of the pistons 12 and 14 in FIG. 5 are controlled with the spool of the cable 112 or 114 driven by two individual bi-directional motors (not shown). The retraction speed of the piston 12 or 14, therefore, is determined by the rotational speed of the motor that is able to rotate in both directions. Alternatively, the pistons 12 or 14 are each individually connected to a compression spring member (not shown) that biases the piston 12 or 14 in the retraction direction 32 during the pump stroke, an accumulator (not shown), or a damper assembly (not shown) to control the speed of the pistons 12 or 14 in the retraction direction 32.

Figure 6A:
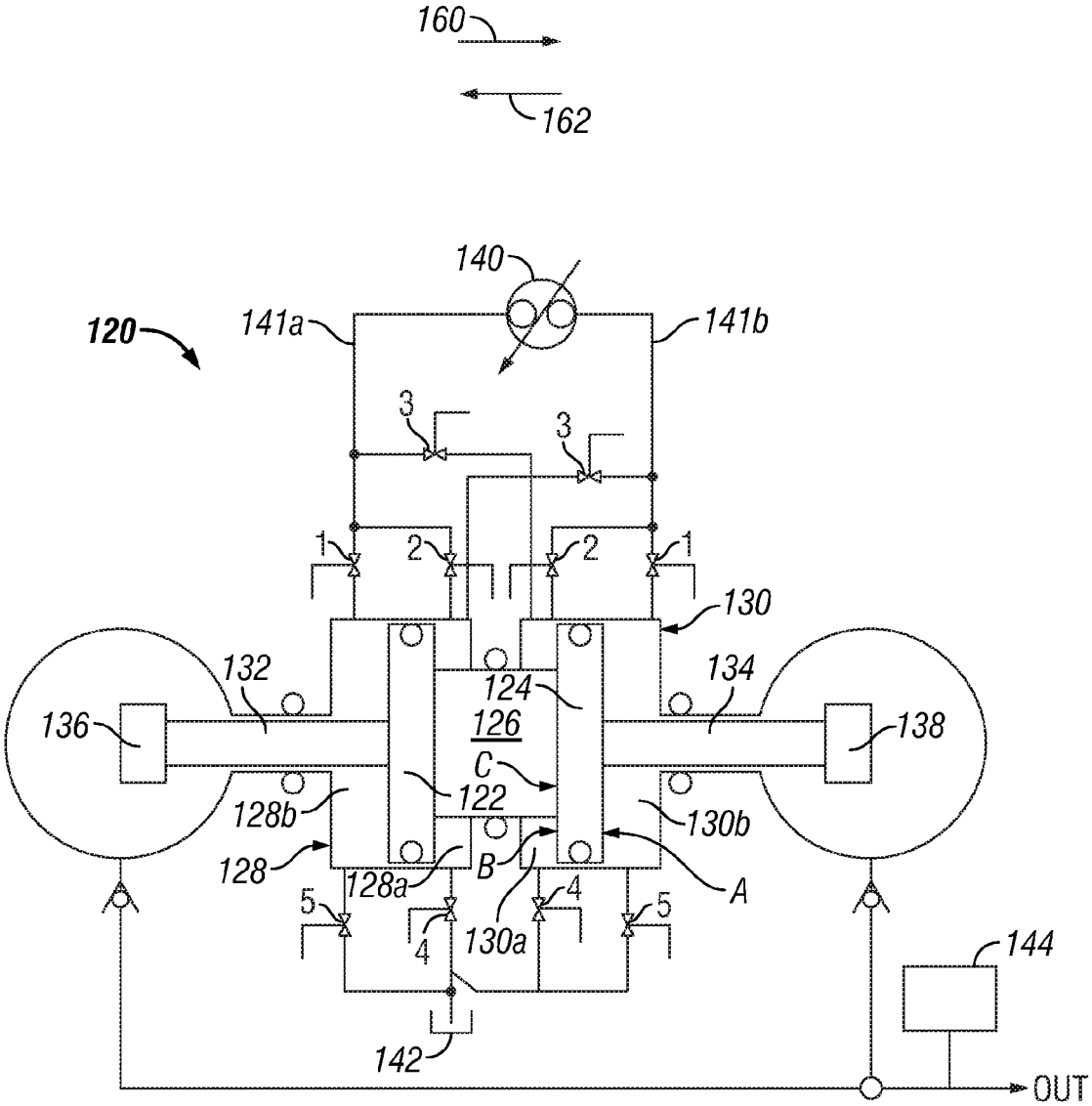
FIG. 6*a* is a schematic view of an alternative embodiment of a system in accordance with the present invention.

Referring now to FIG. 6, an alternative embodiment of a system in accordance with the present invention is indicated generally at 120. The system 120 includes a pair of pistons 122 and 124 connected by an intermediate rod 126. The pistons 122 and 124 are each disposed in a cylinder 128 and 130 having first sides 128*a* and 130*a* adjacent the intermediate rod 126 and a second side 128*b* and 130*b*, respectively. An output rod 132 and 134 extends from each piston 122 and 124 out of the cylinders 128 and 130 and is operatively connected to a respective auxiliary piston, indicated schematically at 136 and 138, such as a multiplier piston or the like, similar to the pistons 24 and 26 shown in FIG. 1. The system 120 is a double-acting system, since working fluid is operable to flow to the working fluid output whether the pistons 122 and 124 are moving in the directions indicated by the arrows 160 and 162.

The system 120 includes a reversible hydraulic pump or prime mover 140 that is operable to supply pressured fluid to the cylinder sides 128*a*, 128*b*, 130*a*, and 130*b*. Alternatively, the prime mover 140 is a unidirectional hydraulic pump and includes one or more control valves (not shown) to select the direction of fluid flow, as will be appreciated by those skilled in the art. A plurality of preferably remotely actuated valves, discussed in more detail below, are operable to route the output flow of the prime mover 140 to the appropriate cylinder side 128*a*, 128*b*, 130*a*, and 130*b* or from the cylinder sides 128*a*, 128*b*, 130*a*, and 130*b* to a sump or output 142.

A first set of valves 1 connects the output of the prime mover 140 to the second sides 128*b* and 130*b* of the cylinders 128 and 130. A second set of valves 2 connects the output of the prime mover 140 to the first sides 128*a* and 130*a* of the cylinders 128 and 130. A third set of valves 3 connects the output of the prime mover 140 to the first sides 128*a* and 130*a* of the cylinders 128 and 130. A fourth set of valves 4 connects the first sides 128*a* and 130*a* of the cylinders 128 and 130 to the sump 142. A fifth set of valves 5 connects the second sides 128*b* and 130*b* of the cylinders 128 and 130 to the sump 142. Each of the valve sets 1, 2, 3, 4, and 5 are preferably actuated by a controller (not shown) or the like, which also receives control signals, such as pressure, temperature, and position indications from the other components of the system 120

During operation of the system 120, the prime mover 140 is operated whereby high pressure fluid alternately flows from the prime mover 140 to output lines 141*a* and 141*b*.

In a first mode of operation A, the valve sets 1 and 4 are open, and the valve sets 2, 3, and 5 are closed, allowing fluid to flow from the output line 141*a* to the second sides 128*b* and from the first side 128*a* to the sump 142 and, when the prime mover 140 output is reversed, from the output line 141*b* to the second side 130*b* and from the first side 130*a* to the sump 142. In mode A, the effective area of operating pressure is the area of the pistons 122 and 124, less the area of the output rods 132 and 134.

In a second mode of operation B, the valve set 2 and the valve set 5 are open and the valve sets 1, 3, and 4 are closed, allowing fluid to flow from the output line 141*a* to the first side 128*a* and from the second side 128*b* to the sump 142 and, when the prime mover 140 output is reversed, from the output line 141*b* to the first side 130*a* and from the second side 130*b* to the sump 142. In mode B, the effective area of operating pressure is the area of the pistons 122 and 124, less the area of the intermediate rod 126.

In a third mode of operation C, the valve sets 1 and 2 are open and the valve sets 3, 4, and 5 are closed, allowing fluid to flow from the output line 141*a* to the first side 128*a* and the second side 128*b* and, when the prime mover 140 output is reversed, from the output line 141*b* to the first side 130*a* and the second side 130*b*. In mode B, the effective area of operating pressure is the area of the pistons 122 and 124, less the area of the intermediate rod 126 and less the area of the output rods 132 and 134, respectively.

In a fourth mode of operation D (or A+B), the valve sets 1 and 3 are open and the valve sets 2, 4, and 5 are closed, allowing fluid to flow from the output line 141*a* to the second side 128*b* and the first side 130*a* and, when the prime mover 140 output is reversed, from the output line 141*b* to the second side 130*b* and the first side 128*b*. In mode D, the effective area of operating pressure is the area of the pistons 122 and 124, less the area of the output rods 132 and 134 (the area of mode A) and, in addition, the area of the pistons 122 and 124, less the area of the intermediate rod 126 (the area of mode B).

Figure 6B:
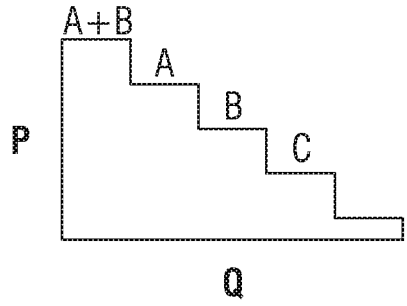
FIG. 6*b* is a pressure vs. flow diagram of the system shown in FIG. 6*a*.

As shown in FIG. 6*b*, an output pressure to flow curve for each mode is shown, whereby mode D has the highest pressure and lowest flow, while mode C has the lowest pressure and highest flow. For all of these modes, the flow rate and pressure of the prime mover 140 may be varied across the operating range of the prime mover 140. This variation allows the system to reach any flow rate and pressure combination down and left of the maximum flow and pressure rating of the mode, represented by the upper right corner of each mode. The system 120 including the intermediate rod 126 disposed between hydraulic pistons 122 and 124 advantageously provides four different operating pressure ratios depending on the mode of operation selected by the operator or controller. The ratios of the areas of the working parts (pistons 122 and 124 and intermediate rod 126) allow the operating area shown in FIG. 6*b* to be chosen to approximate a desired curve, such as a constant power curve or some other desirable characteristic.

Figure 7:
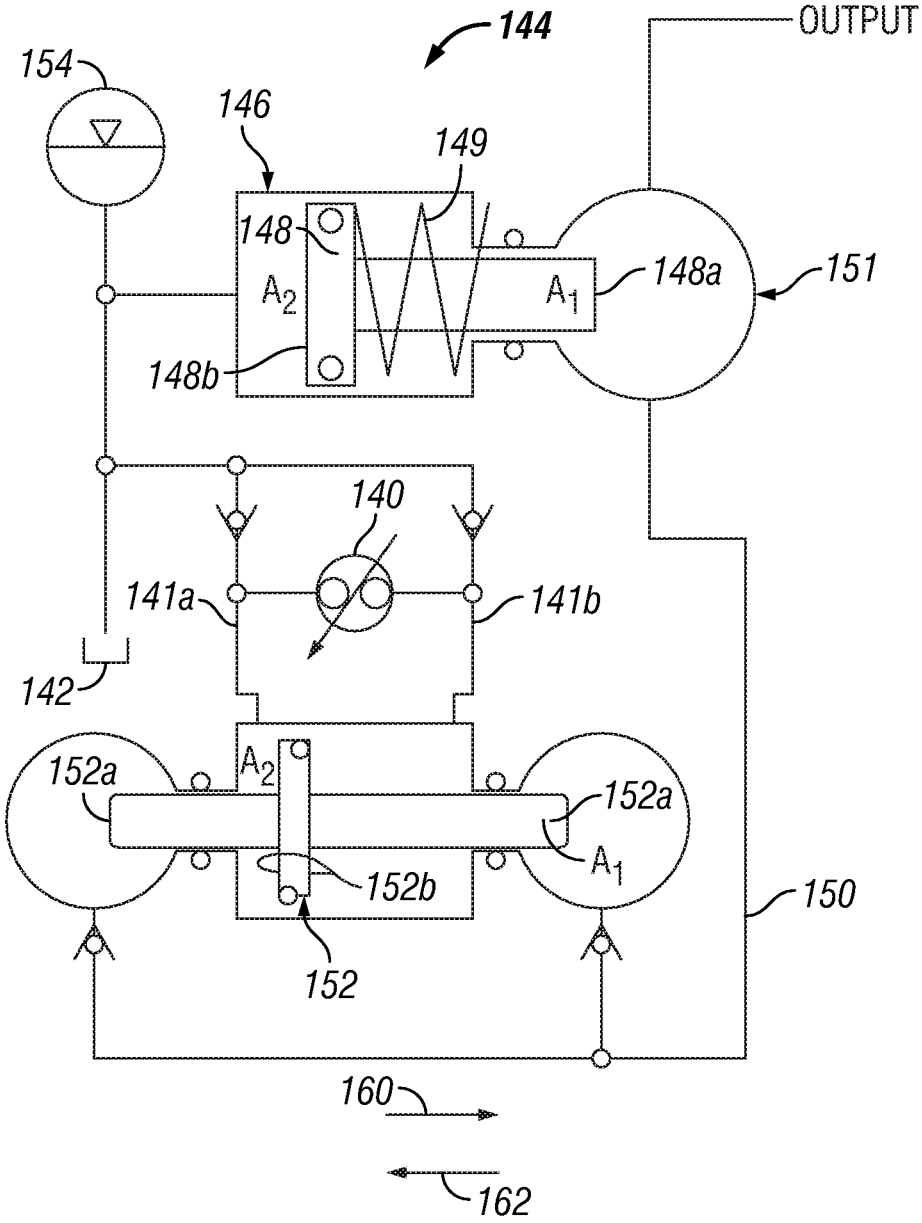
FIG. 7 is a schematic view of alternative embodiment of a system in accordance with the present invention.

A pressure conditioning system, indicated schematically at 144 in FIG. 6 and in more detail in FIG. 7 is in fluid communication with on output of the auxiliary pistons 136 and 138, and is operable to condition the output flow from the system 120. The system 144 includes a cylinder 146 having a piston 148 reciprocatingly movable therein. A spring 149 (or other bias system such as gas or an accumulator) biases the piston 148 in the direction 162. A first end 148*a* of the piston 148 is in communication with a cavity 151, which is in fluid communication with an output 150 of a multiplier piston 152. Only one piston 152 is shown for clarity and the piston 152 includes a first and second multiplier end 152*a* and a power end 152*b*. A second end 148*b* of the piston 148 is in fluid communication with the outputs 141*a* and 141*b* of the prime mover 140. An accumulator 154 or similar discharge stabilizer is in fluid communication with the second end 148*b* of the piston 148. Preferably, the ratio of the area of the end of the piston 148*b* to the area of piston 148*a* is substantially equal to the ratio of the area of the piston 152*b* to the area of piston 152*a*. By carefully sizing the areas of the piston ends 148*a*, 148*b*, 152*a*, and 152*b* and by choosing the spring constant of the spring 149, the system 144 is advantageously self-balancing, thereby reducing shocks in the output line 150.

During operation of the prime mover 140, when the multiplier piston 152 moves in the direction 160, working fluid will flow from the multiplier piston 152 to the working fluid output 150. During this time, the end 148*a* of the piston 148 in the pressure conditioning system 144 is moving in the opposite direction 162 and compressing the spring 149 and pressurizing the cylinder 146 adjacent the piston end 148*b*. When piston 152*a* has reached the end of its stroke and is reversing, the output pressure in cavity 151 will start to decrease and piston 148*a*, impelled by the gas stored in accumulator 154, will move in the direction 162 to maintain the pressure at the output 150 by delivering fluid. When piston 152*a* has started to move again, the spring bias 149 will cause piston 148*a* to retract and reset itself. This retraction behavior may be controlled by a set of orifices and check valves (not shown) or a similar means known to those skilled in the art to limit the dip seen in the pressure in the output 150 while the resetting of the piston 148*a* occurs. The system 144 allows the accumulator 154 to operate on the output pressure 150 without the difficulty of having the output fluid in contact with the accumulator 154. Alternatively, the accumulator 154 is eliminated and replaced by a predetermined quantity of fluid such as gas or the like directly inside cylinder 146. In this case or in general it may be advantageous to eliminate the precharge pressure adjustment provided by the connection to the prime mover. The conditioning system 144 can provide substantially uniform or conditioned flow output with a single double-acting piston, such as that shown in FIG. 7, the system 120 including an intermediate piston shown in FIG. 6, and numerous types of systems where a uniform and/or conditioned fluid output flow from a multiplier piston or similar apparatus is desirable. For example, the conditioning system 144 may be utilized in conjunction with the systems 50, 70, 90, and 110 to provide a substantially uniform output flow while remaining within the scope of the present invention.

The preceding description has been presented with reference to presently preferred embodiments of the invention. Persons skilled in the art and technology to which this invention pertains will appreciate that alterations and changes in the described structures and methods of operation can be practiced without meaningfully departing from the principle, and scope of this invention. Accordingly, the foregoing description should not be read as pertaining only to the precise structures described and shown in the accompanying drawings, but rather should be read as consistent with and as support for the following claims, which are to have their fullest and fairest scope.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

We claim:

1. An assembly for providing a substantially uniform output flow from at least one power piston of a pump powered by a prime mover, the assembly comprising:
   - at least one power piston disposed in a cylinder and reciprocatingly movable within the cylinder between an extension direction when supplied with power from the prime mover and an opposite retraction direction; and
   - a synchronization element attached to the at least one power piston, the synchronization element comprising:
     - a piston disposed in a compensation cylinder and reciprocatingly movable within the compensation cylinder to control the speed of the at least one power piston in the retraction direction, and
     - wherein the synchronization element further comprises a cable attached to the at least one power piston, the cable routed along a plurality of pulleys, at least one of the pulleys movably attached to the compensation cylinder.

2. The assembly according to claim 1 wherein the synchronization element biases the at least one power piston in the retraction direction.

3. The assembly according to claim 1 wherein the at least one power piston is connected to an output rod extending from the cylinder in which the at least one power piston is reciprocatingly moveable.

4. The assembly according to claim 1 wherein the synchronization element increases the speed of the at least one power piston in the retraction direction.

5. The assembly according to claim 1 wherein the prime mover powers a hydraulic source for supplying hydraulic pressure to a power side of the at least one power piston.

6. An assembly for providing a substantially uniform output flow in a pressure multiplier pump, the assembly comprising:
   - a prime mover operable to supply power;
   - a plurality of power pistons each disposed in a cylinder and reciprocatingly movable within the corresponding cylinder between an extension direction when supplied with power from the prime mover and an opposite retraction direction; and
   - a synchronization element attached to each of the power pistons, the synchronization element comprising a piston disposed in a compensation cylinder and reciprocatingly movable within the compensation cylinder to control the speed of each of the power pistons in the retraction direction;
   - wherein the synchronization element further comprises a cable attached to each of the power pistons, the cable routed along a plurality of pulleys, at least one of the pulleys movably attached to the compensation cylinder.

7. The assembly according to claim 6 wherein the pump is a one of a duplex, a triplex pump, a four-plex pump, and a quintuplex pump.

8. The assembly according to claim 6 wherein the prime mover powers a hydraulic source for supplying hydraulic pressure to a power side of each of the power pistons.

9. The assembly according to claim 6 wherein the synchronization element increases the speed in the retraction direction of one of the power pistons while the other of the power pistons is moving in the extension direction.

10. The assembly according to claim 6 wherein each of the power pistons are connected to an output rod extending from the corresponding cylinder in which each of the power pistons are reciprocatingly moveable.

11. The assembly according to claim 10 wherein each of the output rods is further connected to a pressure multiplier piston.

12. The assembly according to claim 6, wherein the synchronization element retracts the power pistons at different speeds.

13. The assembly according to claim 6 wherein the synchronization element comprises a plurality of compensation cylinders and a plurality of pistons reciprocatingly moveable within a corresponding compensation cylinder.

14. The assembly according to claim 6 whereby a predetermined flow of oil to the compensation cylinder increases the speed in the retraction direction of a power piston while another power piston is moving in the extension direction.

15. An assembly for providing a substantially uniform flow output from a multi-piston pressure multiplier, comprising:

a prime mover operable to provide a supply of pressured hydraulic fluid;

a plurality of power pistons each disposed in a cylinder and including a power side and an opposite return side, each of the power pistons reciprocatingly movable within the cylinder between an extension direction when the power side of the piston is supplied with pressured hydraulic fluid from the prime mover and an opposite retraction direction;

an output rod connected to each of the power pistons, each of the output rods extending from the cylinder and further connected to a corresponding pressure multiplier piston, each of the pressure multiplier pistons in fluid communication with a source of pumping fluid and a discharge destination for the pumping fluid;

an intermediate rod disposed between the power pistons and a plurality of valves operable to communicate flow from the pressured hydraulic fluid to the power sides and return sides of each of the power pistons and from the power sides and return sides of each of the power pistons to a sump in predetermined combinations, each of the combinations operable to produce a predetermined pressure and flow to the discharge destination; and a synchronization element attached to one of the power pistons and an output of the pressure multiplier pistons to provide substantially uniform flow output from the pressure multiplier pistons to the discharge destination for the pumping fluid, the synchronization element comprising a piston disposed in a compensation cylinder and reciprocatingly movable within the compensation cylinder.

16. The assembly according to claim 15 wherein the synchronization element is attached to each of the power pistons to control the speed of each power piston in the retraction direction by increasing the speed of each power piston in the retraction direction.

17. The assembly according to claim 15 wherein the synchronization element is a pressure conditioning system attached to an output of the pressure multiplier pistons, wherein the piston of the synchronization element is in fluid communication the prime mover and the output of the pressure multiplier pistons, wherein the pressure conditioning system is operable to store pumping fluid and release pumping fluid to the discharge destination when flow from the output of the pressure multiplier pistons drops below a predetermined value.

* * * * *